United States Patent [19]

Wallace

[11] Patent Number: 4,850,495

[45] Date of Patent: Jul. 25, 1989

[54] TUBULAR ARTICLE CLIP APPARATUS

[76] Inventor: Edward R. Wallace, 11101 N. Lincoln Blvd., Oklahoma, Okla. 73114

[21] Appl. No.: 179,336

[22] Filed: Apr. 8, 1988

[51] Int. Cl.[4] ..... B65D 23/12

[52] U.S. Cl. ..... 215/101; 215/1 A; 215/100 R; 220/85 D; 220/90.2; 229/103.1

[58] Field of Search ..... 215/100 R, 101; 220/85 D, 90.2, 85 R; 24/3 R, 5, 3 J, 3 L, 11 F, 11 CT; 229/103.1; 239/33

[56] References Cited

U.S. PATENT DOCUMENTS

| | | | |
|---|---|---|---|
| 307,408 | 10/1884 | Myers | 24/11 CT |
| 874,215 | 12/1907 | Lewis | 24/11 CT |
| 960,092 | 5/1910 | Hunter | 24/11 F |
| 1,204,053 | 11/1916 | Moore | 24/11 F |
| 1,392,388 | 10/1921 | Amato | 24/11 CT |
| 1,643,661 | 9/1927 | Kendall | 220/85 D |
| 2,070,495 | 2/1937 | Strutz et al. | 215/100 R |
| 2,132,058 | 10/1938 | Tofte | 215/101 |
| 2,569,704 | 10/1951 | Weiss | 24/11 F X |
| 2,594,896 | 4/1952 | Feldman | 215/100 R |
| 2,689,149 | 9/1954 | Saltzman | 215/1 A X |
| 2,787,395 | 4/1957 | Florio | 215/100 R |
| 3,226,001 | 12/1965 | Sequeira | 215/1 A X |
| 3,983,602 | 10/1956 | Barry | 24/3 R X |
| 4,607,755 | 8/1986 | Andreozzi | 215/1 A |

FOREIGN PATENT DOCUMENTS

| | | | |
|---|---|---|---|
| 196681 | 4/1923 | United Kingdom | 24/11 CT |

*Primary Examiner*—Sue A. Weaver

[57] ABSTRACT

A clip apparatus (10) for use in combination with a receptacle (200) and a tubular article (100), wherein the clip apparatus (10) comprises a horizontally disposed article retention member (12) operatively attached to a first (13) and second (14) vertically disposed receptacle grasping members.

2 Claims, 1 Drawing Sheet

FIG. 1.
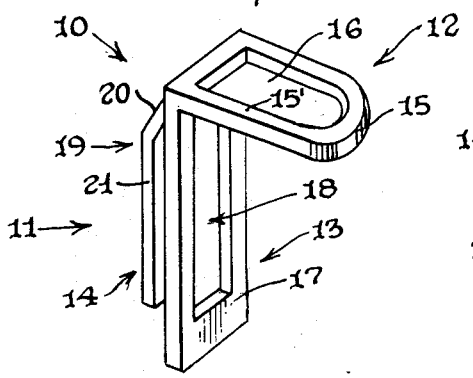
FIG. 2.
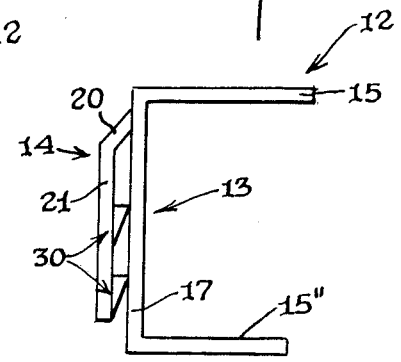
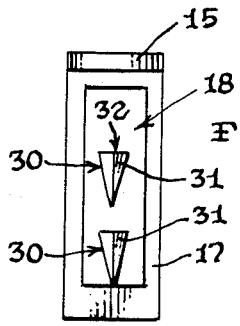
FIG. 3.
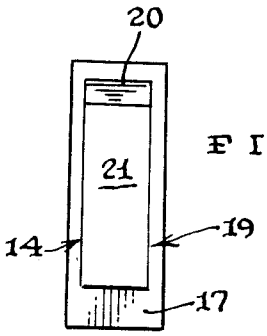
FIG. 4.
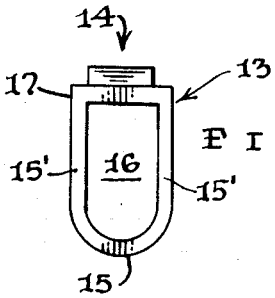
FIG. 5.
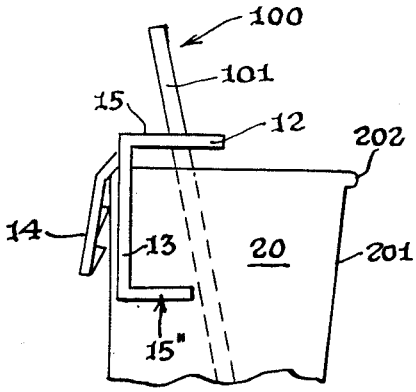
FIG. 6.

portion (21) of the second receptacle grasping member (14) is provided with a plurality of generally traingular gripping teeth elements (30) having angled sides (31) and a generally flat horizontally disposed top surface (32).

By now it should be appreciated that the lower portion (21) of the second receptacle grasping member (14) is capable of being flexed away from the first receptacle grasping member (13), to increase the spacing between the bottom portions of both the first (13) and second (14) receptacle grasping members, to accommodate the insertion of the wall (201) of a receptacle (200) between the respective receptacle grasping members (13) (14) as depicted in FIG. 6.

It should also be appreciated by reference to FIG. 6 that in those instances wherein the receptacle (200) is provided with a pronounced lip portion (202), the receptacle lip portion (202) may be selectively positioned above a selected one of the plurality of gripping teeth elements (30) to position the article receiving member (12) at different heights above the top of the receptacle (200).

It should further be appreciated that the angled sides (31) and the generally flat horizontally disposed top surface (32) of the gripping teeth elements (30) act as ratchet surfaces relative to the lip (202) of the receptacle (200); whereby, the upward passage of the receptacle lip (202) between the first (13) and second (14) receptacle grasping members is facilitated, while the downward passage of the receptacle lip is impeded in a well recognized fashion. Furthermore, in instances wherein the receptacle walls (201) are fabricated from a flexible material, such as waxed paper, or the like; the plurality of gripping teeth elements (30) are capable of deforming the walls (201) of the receptacle (200) to further enhance the grip of the appratus (10) relative to the receptacle (200).

As mentioned earlier on in the specification the clip apparatus (105) of this invention was developed specifically to retain tubular articles (100) relative to a receptacle (200). Examples of some of the generally tubular articles (100) that are envisioned for use in conjunction with this invention include, but are not limited to the following: straws; pencils; spoons; flowers; pipe cleaners; brushes; skewers; thermometers; incense sticks; etc.

As was also mentioned earlier on in the specification, in the preferred embodiment of this invention the clip apparatus (10) is only provided with a primary tubular article retention element (15), which will loosely receive a tubular article (100) such that the tubular article (100) may be disposed at a pronounced angle relative to the walls (201) of a receptacle, such as is depicted in FIG. 6. However, in the alternate embodiment of the invention shown in phantom in FIGS. 1, 2, and 6, the presence of the auxiliary article retention element (15') also allows the tubular article (100) to be maintained in a generally parallel relationship with the walls (201) of the receptacle.

In closing it should further be noted that the relative dimensioning of the tubular article retention member (12) and the first (13) and second (14) receptacle grasping members, plus the enlarged rectangular aperture (18) in the first receptacle grasping member (13) have been selected to produce a clip apparatus (10) that employs the smallest possible mass of material to accomplish the functional objectives of the clip apparatus. As a consequence the clip apparatus (10) is extremely lightweight, flexible, and inexpensive to manufacture from a material consumption standpoint.

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A clip apparatus for use in combination with a tubular straw and a drinking receptacle wherein the clip apparatus comprises:

a first receptacle grasping member comprising a generally elongated open rectangular element having an enlarged central opening;

a second receptacle grasping member operatively associated with said first receptacle grasping member; wherein the second receptacle grasping member comprises a generally flat leg element having an upper portion connected to said first receptacle grasping member and a lower portion generally parallel to but space from said first receptacle grasping member; and, wherein said leg element is further provided with a plurality of gripping teeth elements which project outwardly from said generally flat leg element and which are disposed intermediate said first and said second receptacle grasping members; and, a tubular article receiving member operatively associated with said first and second receptacle grasping members wherein said tubular article receiving member comprises a first generally D-shaped primary article retention element which projects outwardly from the top portion of said first receptacle grasping member.

2. The clip apparatus as in claim 1 wherein said tubular article receiving member further comprises a second generally D-shaped auxiliary article retention element which projects outwardly from the bottom portion of said first receptacle grasping member.

* * * * *

TUBULAR ARTICLE CLIP APPARATUS

TECHNICAL FIELD

The present invention relates generally to support devices for elongated tubular articles.

BACKGROUND OF THE INVENTION

This invention was the subject matter of Document Disclosure Program Registration No. 172797 which was filed in the U.S. Patent and Trademark Office on July 6, 1987.

As can be seen by reference to the following U.S. Pat. Nos. 2,689,149; 4,607,755; 3,226,001; and, 2,132,058 the prior art is replete with myriad and diverse straw retention and associated item clip devices that are employed in conjunction with a cylindrical receptacle.

While all of the aforementioned prior art constructions are more than adequate for the particular purpose and function for which they were specifically designed and developed; these prior art constructions also suffer from a number of individual and shared deficiencies such as: undue complexity requiring customized modification of the receptacle structure; limited angular adjustability of the support article relative to the supporting receptacle; and, undue limitations regarding the different types of tubular articles that may be supported by the receptacle.

Based on the foregoing situation there has obviously existed a longstanding need among those individuals who are involved with this type of a device for an improved tubular article support clip apparatus that was simple in construction; inexpensive to manufacture; simple to use; and, widely adapted to accommodate a variety of receptacles and/or tubular articles.

In addition, the tubular article clip apparatus that forms this invention was developed as a result of the need to overcome the aforementioned inherent deficiencies in the prior art constructions, as well as, to satisfy the desired design parameters that are listed above.

BRIEF SUMMARY OF THE INVENTION

Briefly stated, the tubular article clip apparatus that forms the basis of the present invention comprises a clip unit having a tubular article receiving member operatively associated with first and second receptacle grasping members.

As will be explained in greater detail further on in the specification, in the preferred embodiment of this invention the clip apparatus is a single piece construction fabricated from molded plastic or the like.

In addition, in an alternate version of the preferred embodiment the clip apparatus is further provided with an auxiliary tubular article receiving member; wherein the primary tubular article receiving member is disposed on the top of one of the receptacle grasping members; and, wherein the auxiliary tubular article receiving member is disposed on the bottom of the same receptacle grasping member.

As will also be explained in greater detail further on in the specification the receptacle grasping members are operatively and flexibly secured to one another; whereby, the space between the receptacle grasping members may be increased to accommodate receptacle edges of different thicknesses.

In addition, one of the receptacle grasping members is provided with gripping elements that are spaced to accommodate the clip unit at different heights relative to the lip of a given receptacle; wherein, the gripping elements are further adapted to partially deform the side wall of a flexible receptacle, to insure a tight frictional securement of the clip unit relative to the receptacle member.

BRIEF DESCRIPTION OF THE DRAWINGS

These and other objects, advantages and novel features of the invention will become apparent from the detailed description of the best mode for carrying out the preferred embodiment of the invention which follows; particularly when considered in conjunction with the accompanying drawings, wherein:

FIG. 1 is a perspective view of the tubular article clip apparatus of this invention;

FIG. 2 is a side plan view of an alternate version of the apparatus;

FIG. 3 is a front plan view of the apparatus;

FIG. 4 is a rear plan view of the apparatus;

FIG. 5 is a top plan view of the apparatus; and,

FIG. 6 is a side elevation view of the alternate version of the apparatus mounted on a receptacle.

BEST MODE FOR CARRYING OUT THE INVENTION

As can be seen by reference to the drawings and in particular to FIG. 1, the tubular article clip apparatus that forms the basis of the present invention is designated generally by the reference numeral (10). The clip apparatus (10) comprises in general: a clip unit (11) which includes a tubular article receiving member (12); a first receptacle grasping member (13); and, a second receptacle grasping member (14). These members will now be described in seriatim fashion.

As can best be seen by reference to FIGS. 1, 2, and 5, the tubular article receiving member (12) comprises an elongated horizontally disposed generally D-shaped article retention element (15); wherein, the legs (15') of the retention element (15) are integrally connected to the upper portion of the first receptacle grasping member (13) to define an enlarged generally D-shaped aperture (16), which is dimensioned to receive at least a portion of the shaft (101) of a generally tubular article (100).

As best shown in FIGS. 1 thru 3, the first receptacle grasping member (13) comprises an elongated vertically disposed generally open rectangular element (17) having an enlarged central aperture (18). In the preferred embodiment of this invention there is only one primary retention element (15) which projects outwardly from the top of the first receptacle grasping member (13). However, in an alternate version of the preferred embodiment depicted in FIGS. 2, and 6, there is an auxiliary retention element (15'') which projects outwardly from the bottom of the first receptacle grasping member (13); and, the purpose and function of this auxiliary retention element (15'') will be discussed in greater detail further on in the specification.

As can best be seen by reference to FIGS. 1 thru 4, the second receptacle grasping member (14) comprises a relatively narrow angled leg element (19) having an upper portion (20 that projects outwardly and downwardly from the top of the first receptacle grasping member (13); and, having a lower portion (21) which is disposed generally parallel to, and spaced from, the first receptacle grasping member (13). In addition, the lower